US006727825B2

(12) United States Patent
Yoshida et al.

(10) Patent No.: US 6,727,825 B2
(45) Date of Patent: Apr. 27, 2004

(54) STRUCTURE OF STRING RESISTOR BODY IN AN OPERATION PANEL DEVICE

(75) Inventors: Motomasa Yoshida, Nagoya (JP); Yoshinobu Kobayashi, Nagoya (JP); Kenji Okamoto, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 131 days.

(21) Appl. No.: 10/124,369

(22) Filed: Apr. 18, 2002

(65) Prior Publication Data

US 2002/0153239 A1 Oct. 24, 2002

(30) Foreign Application Priority Data

Jul. 18, 2001 (JP) ..... 2001-119436

(51) Int. Cl.[7] ..... G08B 5/36

(52) U.S. Cl. ..... 340/815.47; 340/815.48; 340/815.73; 340/815.56; 340/815.65; 341/22; 341/26; 341/28; 341/34

(58) Field of Search ..... 340/815.47, 815.48, 340/815.73, 815.56, 815.65; 341/22, 26, 28, 34; 345/170, 168, 156, 173; 200/520, 308, 310, 311

(56) References Cited

U.S. PATENT DOCUMENTS 4,253,044 A * 2/1981 Smith ..... 315/169.4
4,893,115 A * 1/1990 Blanchard ..... 345/174

* cited by examiner

*Primary Examiner*—Jeffery Hofsass
*Assistant Examiner*—Hung T. Nguyen
(74) *Attorney, Agent, or Firm*—Oliff & Berridge, PLC

(57) ABSTRACT

An operation panel 30 is provided with a plurality of operation buttons 36. A string-like resistor body 41 is held in a resistor holding plate 31. The resistor body 41 has a tube-like elastic outer resistor member 42, an inner resistor member 43 loosely arranged within the outer resistor member and insulating spacers 44 arranged between the inner resistor member and the outer resistor member at predetermined intervals in the longitudinal direction of the inner resistor member so that the inner periphery of the outer resistor member 42 and outer periphery of the inner resistor member 43 are constantly separated from each other. A control unit 53 is provided to produce an operation signal.

7 Claims, 10 Drawing Sheets

| OPERATION BUTTON | REFERENCE VOLTAGE |
|---|---|
| $SW_{i=1}$ | $V_{i=1}$ |
| $SW_{i=2}$ | $V_{i=2}$ |
| ⋮ | ⋮ |
| $SW_{i=n}$ | $V_{i=n}$ |

STRUCTURE OF STRING RESISTOR BODY IN AN OPERATION PANEL DEVICE

BACKGROUND OF THE INVENTION

This invention relates to an operation panel device which is suited to an apparatus equipped with a large number of operation switches such as a motor vehicle.

In recent years, a vehicle such as a motor vehicle incorporates various kinds of electric appliances inclusive of a television, navigation system, an audio mechanism such as a CD player, a cassette player, etc. an air conditioner, etc. To this end, various kinds of operation panel devices 8 have been developed in which as seen from FIGS. 12 and 13, a display 1, a CD entrance 2, a cassette entrance 3, a television/navigation operation button 4, an audio operation button 5, an air conditioner operation button 6, indicators 7 are collectively arranged on a center cluster of a dash board.

An operation panel 8*a* of the operation panel device 8 adopts a number of curved surfaces so that the arrangement and angle of the operation buttons 4, 5 and 6 can have variations taking a design into consideration.

However, since the operation panel 8*a* of the operation panel device 8 adopts a number of curved surfaces so that the arrangement and angle of the operation buttons 4, 5 and 6 can have variations, it was requested that printed boards on which switches 10 to be operated by the operation buttons 4, 5 and 6 are mounted are arranged divisionally so as to correspond to the positions of the operation buttons 4, 5 and 6 according to the curved surfaces.

Thus, there was necessity of connecting the divided printed boards 11 to one another via connectors or jumper wires. This led to the cost-up.

Each switch 10 was designed as a "rubber contact switch" to provide tactile feeling when the operation button 4, 5, 6 is pressed. Specifically, as seen from FIGS. 14 to 17, when the operation button 4, 5, 6 is pushed in, an operation shaft 12 of the operation button 4, 5, 6 pushes the switch 10. In this case, the switch 10 is shifted from an initial state as shown in FIG. 15 into a state where a rubber contact 13 is elastically deformed under predetermined force as shown in FIG. 16. Thereafter, as shown in FIG. 17, the rubber contact 13 is abruptly elastically deformed by small operation force. As a result, each switch contact 15 arranged on a switch board 14 is communicated with a contact conductor 16 on the lower surface of the rubber contact 13 so that a predetermined operation signal is produced. Thus, the switch 10 does not almost encounter any operation obstacle while it is shifted from the state of FIG. 16 into the state of FIG. 17, thereby providing the tactile feeling.

Incidentally, in FIG. 14, reference numeral 17 denotes a supporting portion attached to the operation panel 8*a*. In FIGS. 15 to 17, reference numeral 18 denotes a switch cap, 18 a switch gap, 19 a lower case, and 20 an upper cover.

However, the adoption of the rubber contact switch also led to the cost-up.

Further, in order to disperse light by the printed boards 11, the conventional operation panel device incorporates a plurality of light sources 21 for illuminating the operation buttons 4, 5 and 6 and the indicators on the printed board 11 and also a light guiding plate 22 of acryl resin for guiding the light from the light source 21 to the character or graphic on each of the buttons 4, 5, 6 and another light guiding plate 22 for guiding light to each indicator. In this case, the light guiding plates 22 must be designed so that light with predetermined luminous intensity can be guided. This is troublesome and hence leads to the cost up.

SUMMARY OF THE INVENTION

Accordingly, an object of this invention is to provide an operation panel device with freedom of design which can deal with the complicate curved surface of an operation panel at low cost.

The technical means for solving the above problem is an operation panel device equipped with a plurality of operation buttons from each of which the corresponding operation signal is produced according to the operation of each button, characterized in that a string-like resistor body is held in a resistor holding plate, the resistor body having a tube-like elastic outer resistor member, an inner resistor member loosely arranged within the outer resistor member and insulating spacers arranged between the inner resistor member and the outer resistor member at predetermined intervals in the longitudinal direction of the inner resistor member so that the inner periphery of the outer resistor member and outer periphery of the inner resistor member are constantly separated from each other; and a control unit is provided to produce the operation signal, whereby when each operation button is pressed, at the corresponding position, the outer resistor member is elastically deformed to be brought into contact with the inner resistor member so that the control unit decides which operation button is pressed on the basis of the resistance at an individual contact position and produces the corresponding operation signal.

The operation panel device may have a structure in which the resistor holding plate has a groove in which the resistor body is to be firmly positioned.

The operation panel device may have a structure in which a plurality of rubber contacts of an elastic material are arranged so as to correspond to the positions where the outer resistor member is pushed by pressing each the operation buttons, the rubber contacts each including a push-in operation member and a skirt member which is enlarged in the hem toward the outer resistor member.

The operation panel device may have a structure in which a coupling plate is integrally provided to couple the plurality of rubber contacts with one another on the side of their hems.

The operation panel device may have a structure in which the rubber contacts are attached to the resistor holding plate so that the resistor body is held in the groove.

The operation panel device may have a structure in which a light source for illumination is provided within a case of the operation panel device and the resistor holding plate constituting the case is made smooth in the inner surface.

The operation panel device may have a structure in which optical fibers are provided for guiding light to respective indicators of the operation buttons.

DETAILED DESCRIPTION OF THE PREFERRED EMBODIMENTS

Figure 1:
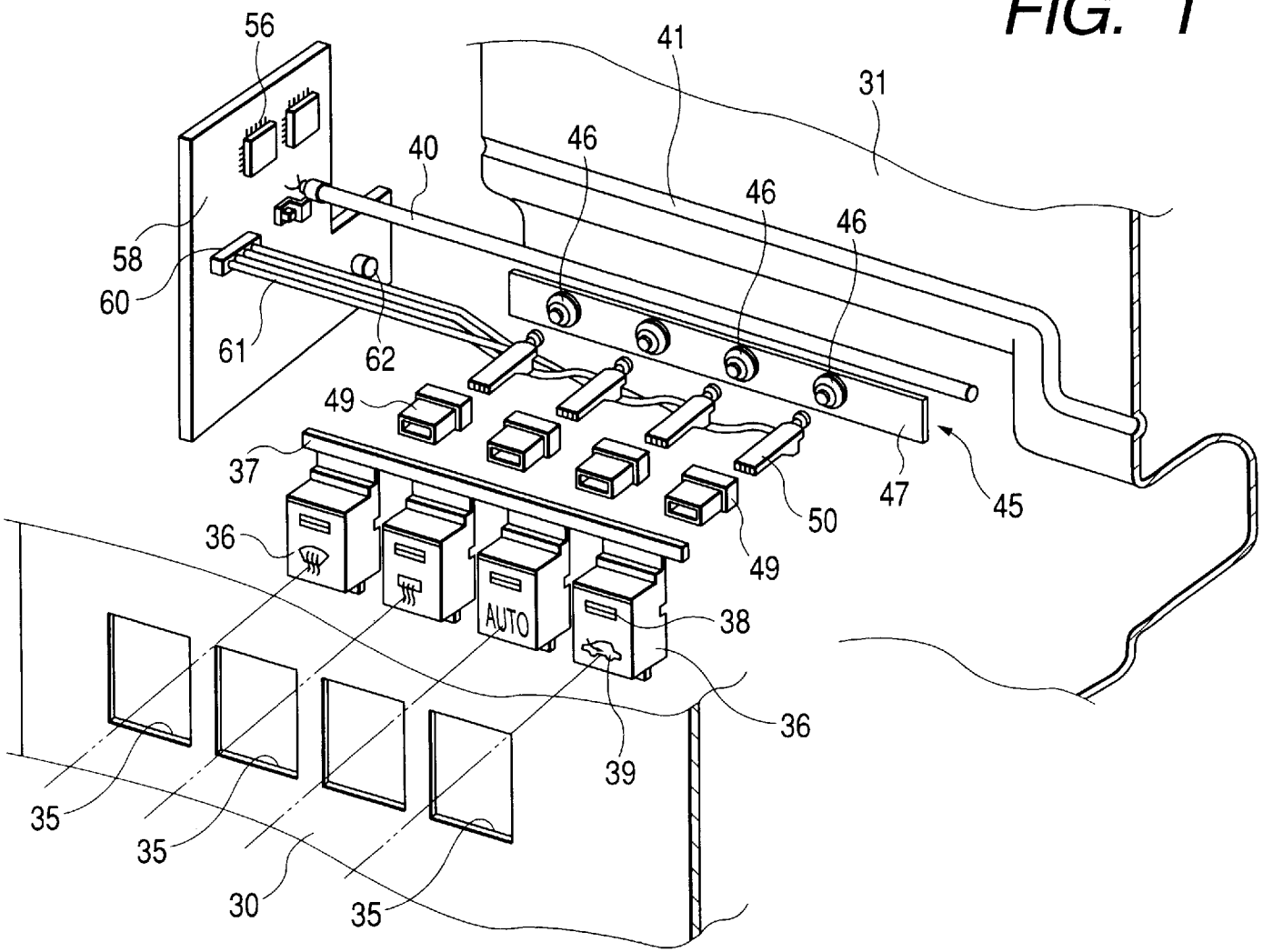
FIG. 1 is an exploded perspective view of the main portion of a first embodiment of this invention.
Figure 2:
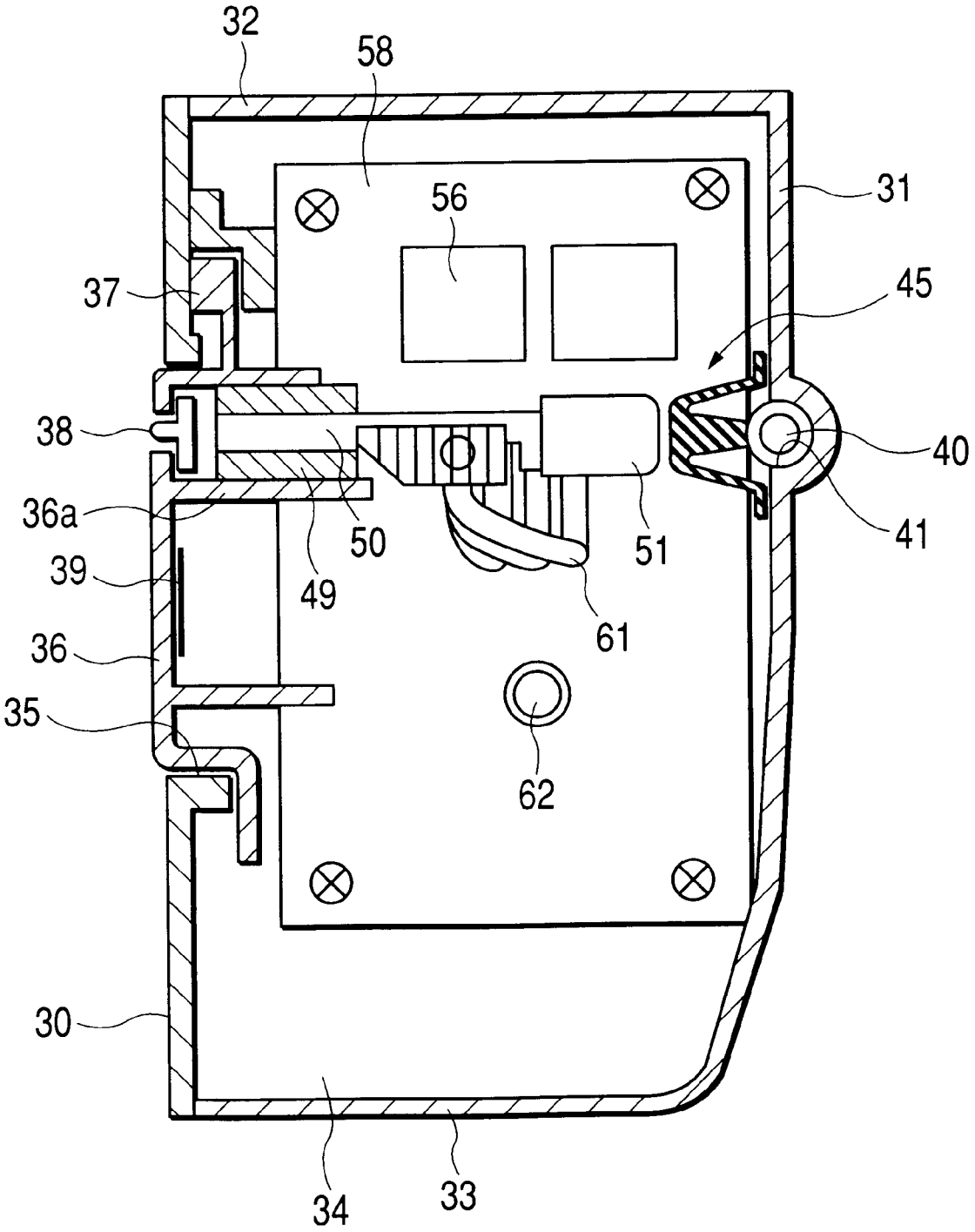
FIG. 2 is a sectional side view of the above main portion.

Now referring the drawings, an explanation will be given of the first embodiment of this invention. As seen from FIGS. 1 and 2, an operation panel device includes a front operation panel 30 on the front side, a resistor holding plate 31 which is a rear panel on the rear side, an upper panel 32 on the upper side, a bottom panel 33 on the bottom side, and side panels 34 on the left and right sides.

The operation panel device is formed as a box by the panels 30, 31, 32, 33 and 34. Each of the panels 30, 31, 32, 33 and 34 is made of e.g. ABS resin, and their inner surface is a smooth surface such as a "mirror face".

The operation panel 30 has a plurality of button windows 35 made at prescribed positions. Respective operation buttons 36 are fit in the button windows 35 and attached to the interior of the operation panel 20. In this case, the respective operation buttons 36 are integrally coupled with one another at their upper end through a supporting shaft 37. The operation buttons 36 are made of flexible resin. The operation buttons 36 in the attached state are adapted so that their lower sides can be pushed in by warping deformation at a fulcrum of the supporting shaft 37.

Each operation button 36 has an indicator 38 equipped with a lens body fit in a slit at the upper portion and a light-transmittable identification mark 39 of a graphic, character, etc. at the lower portion.

The resistor holding plate 31 which is located behind the operation buttons 35 has a concave groove 41 in which a string-like resistor body 40 is to be held, and the string-like resistor body 40 is held in the groove 41 and positioned there.

Figure 3:
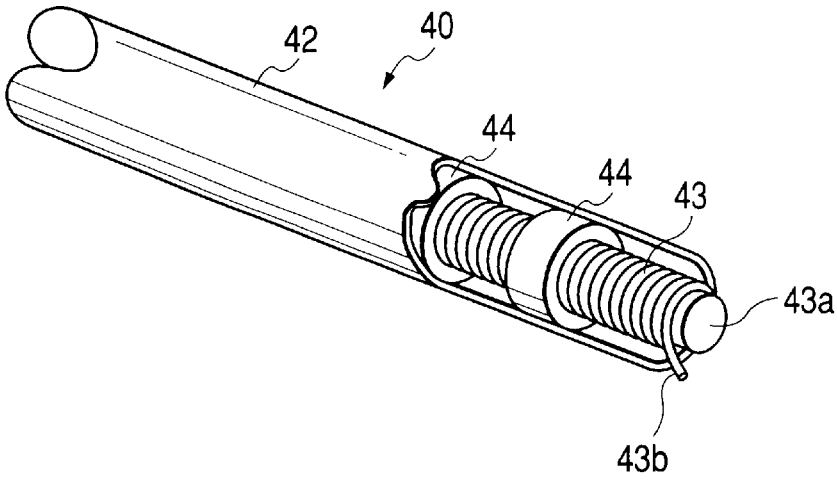
FIG. 3 is a perspective view of a resistor body.

As seen from FIG. 3, the resistor body 40 includes an outer resistor 42 which covers the outside thereof, an inner resistor member 43 which is loosely arranged within the outer resistor member 42, a plurality of insulating spacers 44 of insulating material which are arranged at regular intervals in the longitudinal direction of the inner resistor member 43. The inner periphery of the outer resistor member 42 and outer periphery of the inner resistor member 43 are constantly separated from each other by the insulating spacers 44.

In this embodiment, the inner resistor member 43 includes an insulating cord 43*a* and an enamel wire 43*b* which is wound in a coil-shape in the longitudinal direction at intervals of 1 mm on the outer periphery of the insulating cord 43*a*.

The outer resistor member 42 is formed in a circular tube shape and wholly made of a conductive elastic material such as conductive rubber. The entire outer resistor member 42 constitutes a conductive body. When pushing force is externally acted on the outer resistor member 42 among the insulating spacers 44, the outer resistor member 42 is elastically deformed to be brought into contact with the inner resistor member 43. When the pushing force is released, owing to elasticity, the outer resistor member 42 is restored to an initial state separated from the inner resistor member 43.

Figure 4:
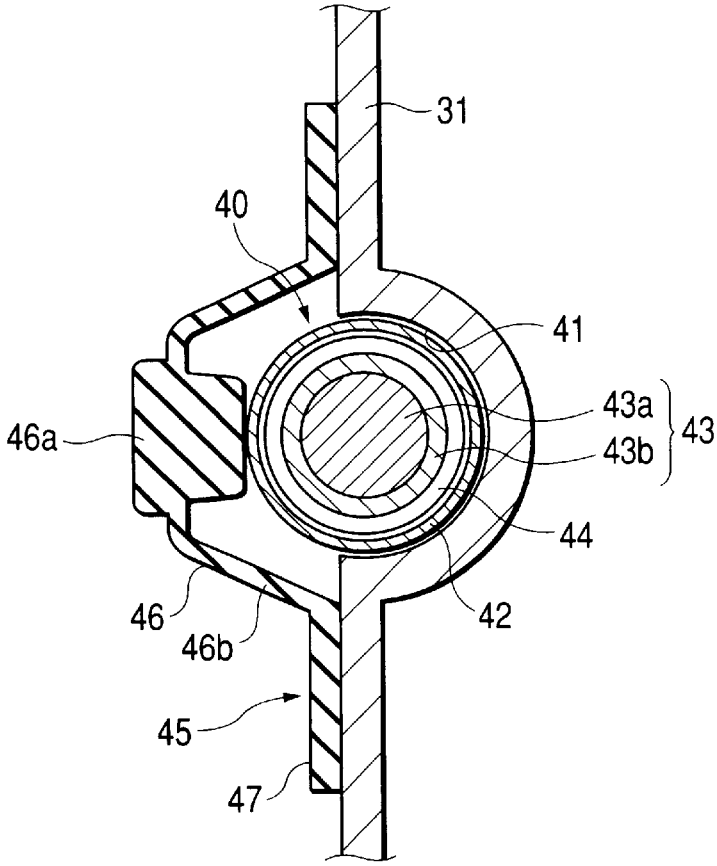
FIG. 4 is an enlarged sectional view of the above main portion.

As seen from FIG. 4, with the resistor body 40 fit in the groove 41, a rubber contact member 45 of an elastic material such as rubber is fixedly put on the front side of the resistor holding plate 31 by adhesive. In this way, the resistor body 40 is fixed in the groove 41 in a state positioned firmly therein.

The rubber contact member 45 includes rubber contacts 46 located corresponding to the push-in operations by the operation buttons 36 and a coupling plate 47 which couples the rubber contacts 46 with one another. Each rubber contact 46 includes a block-shaped push-in operation member 46*a* and a skirt member 46*b* which is enlarged in the hem. On the sides of the hems, the rubber contacts 46 are coupled with one another by the coupling plate 47 which is fixedly put on the resistor holding plate 31. In this state, the inside of the push-in operation member 46*a* is kept in substantial contact with the outer periphery of the outer resistor member 42 of the resistor body 40.

At the position corresponding to each rubber contact 46 on the inside of the operation button 36, the operation button 36 has a cylinder 36*a* in which a square light-shading holder 49 is firmly fit. The front half of a strip-shaped indicator light-guiding plate 50 is firmly fit in a light-shading holder 49. The indicator light conducting plate 50 is made of e.g. acryl resin and serves to guide light to the indicator 38.

At the rear end, the indicator light-guiding plate 50 is equipped with a push-in member 51 which is used to push in the rubber contact member 45. When the operation button 36 is pushed in, the rubber contact 46 is pushed in via the light-shading holder 49, indicator light-guiding plate 50 and push-in member 51. Thus, at the position corresponding to the operation button 36, the outer resistor member 42 and inner resistor member 43 are brought into contact with each other so that they are communicated with each other.

Figures 5, 6:
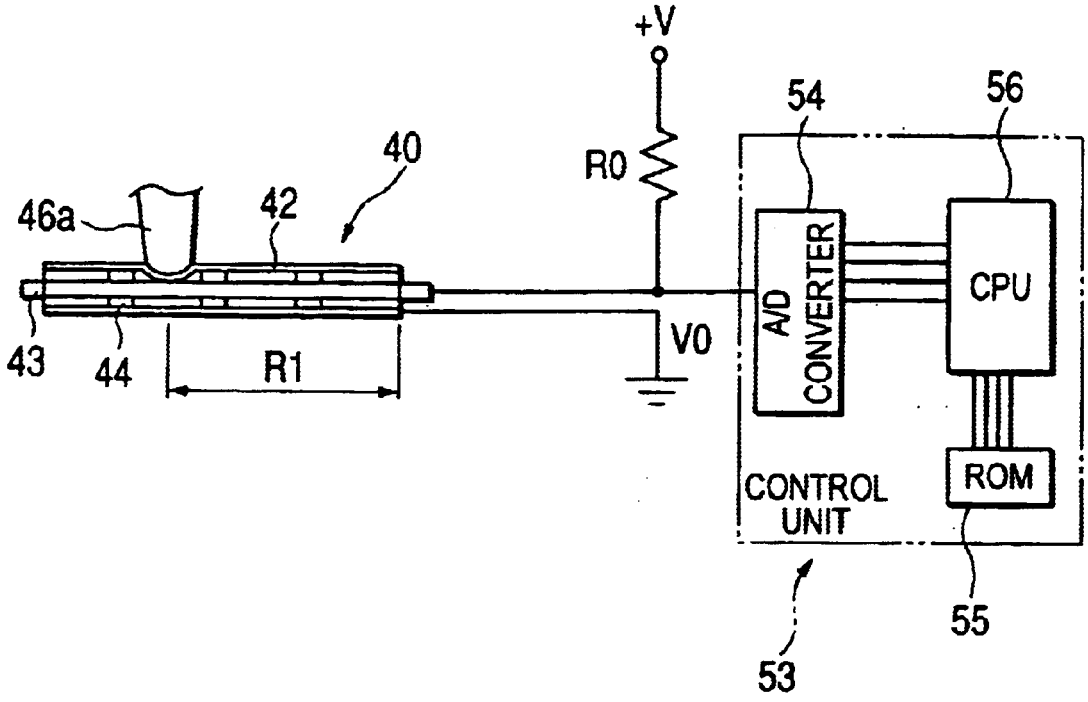
FIG. 5 is a view for explaining the circuit configuration of a control unit.
FIG. 6 is a graph showing the relationship between operation buttons and reference voltages.

FIG. 5 is a view which schematically shows a circuit arrangement of a control unit 53 for deciding which operation button 36 is pressed. The outer resistor member 42 of the resistor body 40 is connected to ground whereas the inner resistor member 43 is connected to a power source through a reference resistor R0 and also connected to an A/D converter 54 of the control unit 53.

As a result that the push-in operation member 46*a* is pushed in by the operation of the operation button 36, when the outer resistor member 42 and inner resistor member 43 are brought into contact with other, the resistor R1 of the resistor body 40 generates an analog voltage V0 in the A/D converter 54. The analog voltage V0 generated at this time is represented by an equation:

$$V0=R1\cdot V/(R0+R1).$$

Therefore, the analog voltage V0 is determined by the value of a resistance R1, i.e. position where the outer resistor member 42 is subjected to the push-in operation. In this case, the push-in position is specified from the detected value of the analog voltage V0 so that which operation button 38 is operated among the operation buttons 36 is decided.

Specifically, as shown in FIG. 6, a ROM of the control unit 53 incorporates a table which shows the relationship between a operation button Swi when each operation button 36 is pressed and the corresponding standard reference voltage Vi acquired at this time. When the voltage Vd of a digital signal converted from the detected analog voltage V0 converted by the A/D converter 54 is supplied to the CPU 56, the voltage Vd is compared with the voltage recorded on the ROM 55. Here, CPU decides that the operation button Swi corresponding to Vi with a smallest voltage difference is pressed, and produces the corresponding operation signal.

A printed board 58 is attached to a side panel 34 on the one side by e.g. screwing. The above control unit 53 is mounted on the printed board 58 and the one end of the resistor body 40 is also fixedly connected to the printed board 58.

Figure 7:
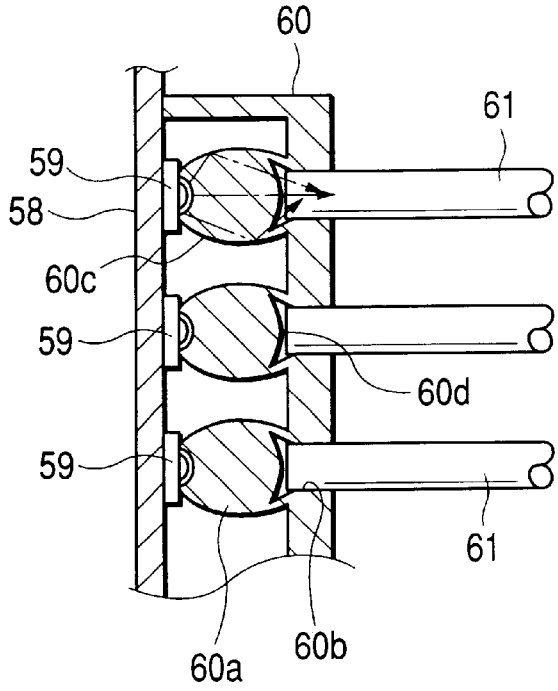
FIG. 7 is a sectional view of a light-source guide holder.
Figure 8:
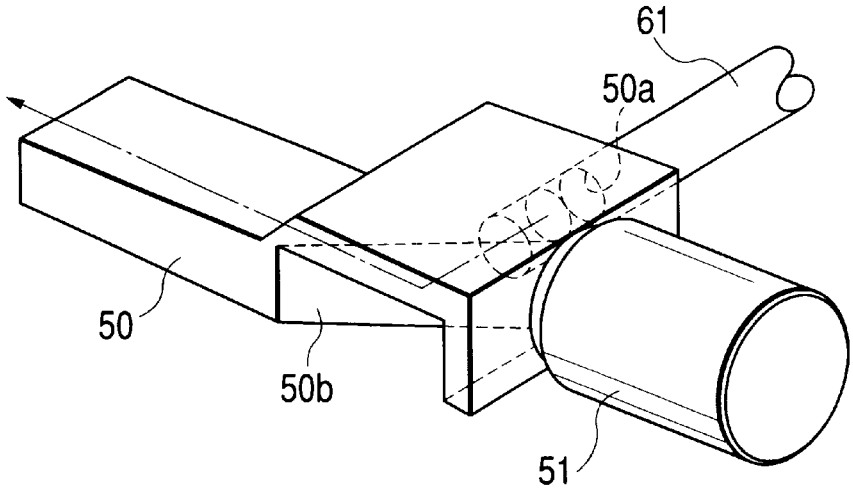
FIG. 8 is a perspective view of an indicator light-guiding plate.

As shown in FIG. 7, a predetermined number of light-emitting diodes 59 which serve as light sources for indicators are mounted on the printed board 58. A light-source guide holder 60 is also mounted on the printed board 58 so as to overlie the respective light-emitting diodes 59.

The light-source guide holder 60 is made of e.g. acryl resin in a shape of a slender box. At a position corresponding to each of the light-emitting diodes 59, the light-source guide holder 60 is provided with an egg-shaped light guiding portion 60*a* which swells at its center and an optical fiber fitting hole 60*b* into which the one end of an optical fiber 61 is fixedly fit. The light-source guide holder 60 is structured so that the light is reflected on a parabolic face 60*c* around the light guiding portion 60*a* in order to guide and condense the quantity of light from the light emitting diode 59 to the end face of the optical fiber 61 effectively and is prevented from being dispersed by the convex face 60*d* opposite to the end face of the optical fiber 61.

The other end of each optical fiber 61 is fixedly fit in an optical fiber fitting hole 50*a* made on the one side of each indicator light guiding plate 50. The light guided onto the other end of the optical fiber 61 is reflected on a slanted reflecting face 50*b* of the indicator light-guiding plate 50 so that it is guided toward the indicator 38.

On the printed board 58, a light source 62 for illumination is also mounted. The light from the light source 62 is reflected on the respective inner faces of the resistor holding plate 31, upper panel 32, bottom panel 33, side panel 34 so that it is guided to each identification mark 39 and others.

Figure 9:
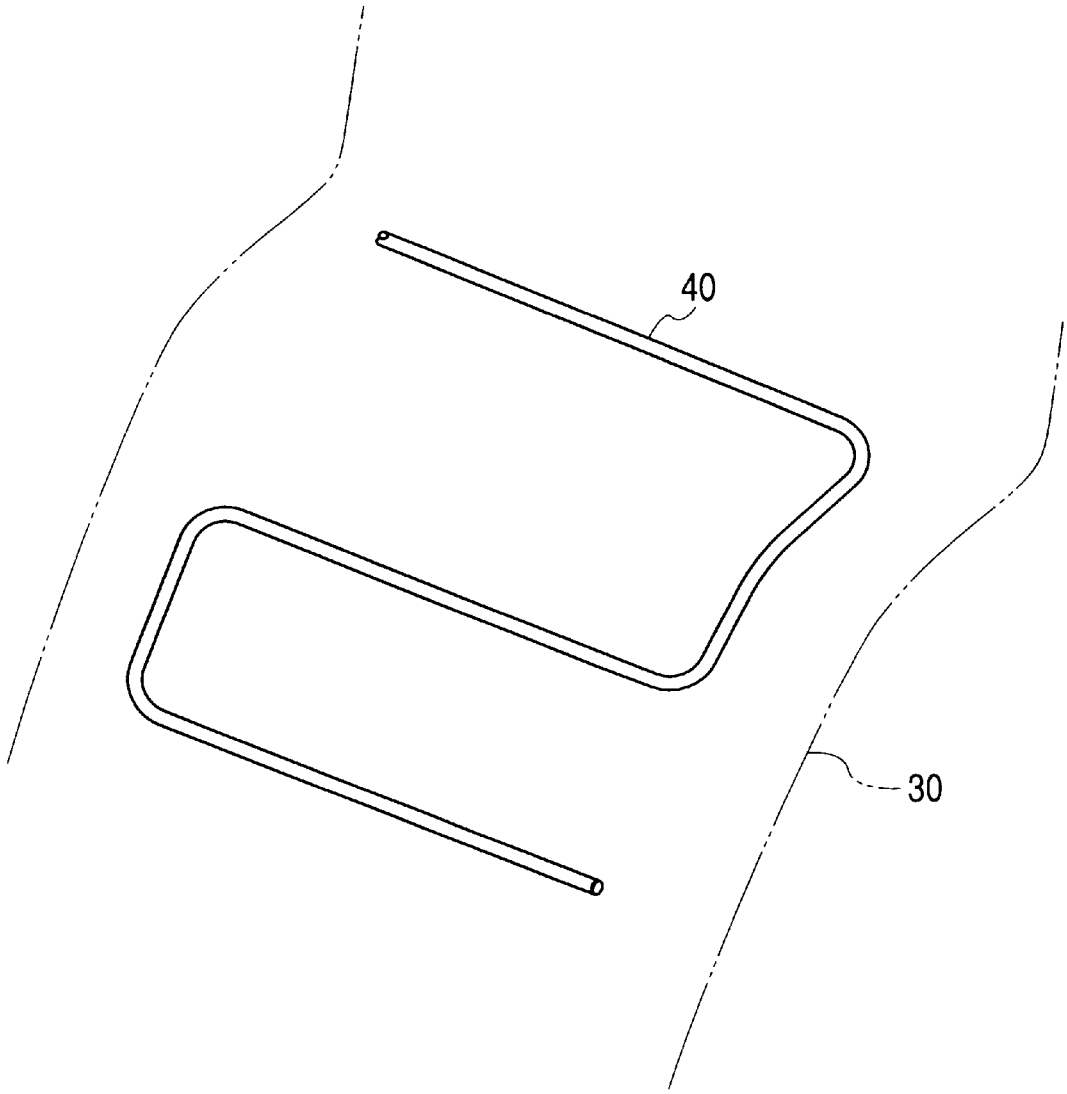
FIG. 9 is a view showing an typical arrangement of the resistor body.

This embodiment is structured, as described above, in which as a means for detecting the operation of each operation button 36, a bendable string-like resistor body 40 is used in place of the switch 10 fixed on the printed board 10. Therefore, even when the operation panel 30 has a complicate curved surface, as indicated in a phantom line in FIG. 9, the resistor body 40 can be easily arranged along a varying curved surface. Thus, the freedom in the design of the operation panel can be improved. In this case, the arrangement of the corresponding operation buttons 36 may be defined for the resistor body 40 at the same relative positions as described above.

In accordance with this invention, it is not necessary to use expensive printed boards, a connecting structure therebetween and rubber contact switches. This contribute to the cost reduction.

Further, since the resistor holding plate 31 has the groove 41 for firmly positioning the resistor body 40, the resistor body 40 has only to be arranged along the groove. Thus, the resistor body 40 can be easily positioned and its deviation from the correct position can be effectively prevented. This improves the workability of arrangement of the resistor body 40.

The rubber contact body 46 having the same structure as that of the rubber contact switch is provided so as to correspond to the operation body of each operation button 36. This assures the same tactile feeling as the rubber contact switch does.

Further, by fixedly putting the rubber contact member 45 on the resistor holding plate 31, the resistor body 40 can be fixed. This makes it unnecessary to use the member for fixing the resistor body 40 so that the common use of the member is made and the workability of assembling can be improved.

The light from the light source 62 for illumination can be guided to necessary positions by the reflection on the inner surface of each of the panels 30, 31, 32, 33 and 34. This makes it unnecessary to use the light-guiding plate 22 used conventionally, and can provide the simplified structure at low cost.

Further, since the indicators 38 are supplied with the light via the optical fibers 61, the flexibility of the optical fibers 61 permits the positions of arranging the indicators 38 to be easily changed. This improves the freedom of designing the operation panel.

In accordance with the resistor body 40 having the structure as described above, the resistor body 40 having a length of 1 m permits 28 positions involved with the switch operation at intervals of 15–16 mm to be discriminated accurately in terms of a prescribed threshold value. Therefore, where the number of the operation buttons 36 of various kinds of appliances is 28 or less, the operations of the operation buttons 36 can be discriminated from one another using the single resistor body 40. Thus, the structure of the operation panel device can be advantageously simplified.

Figure 10:
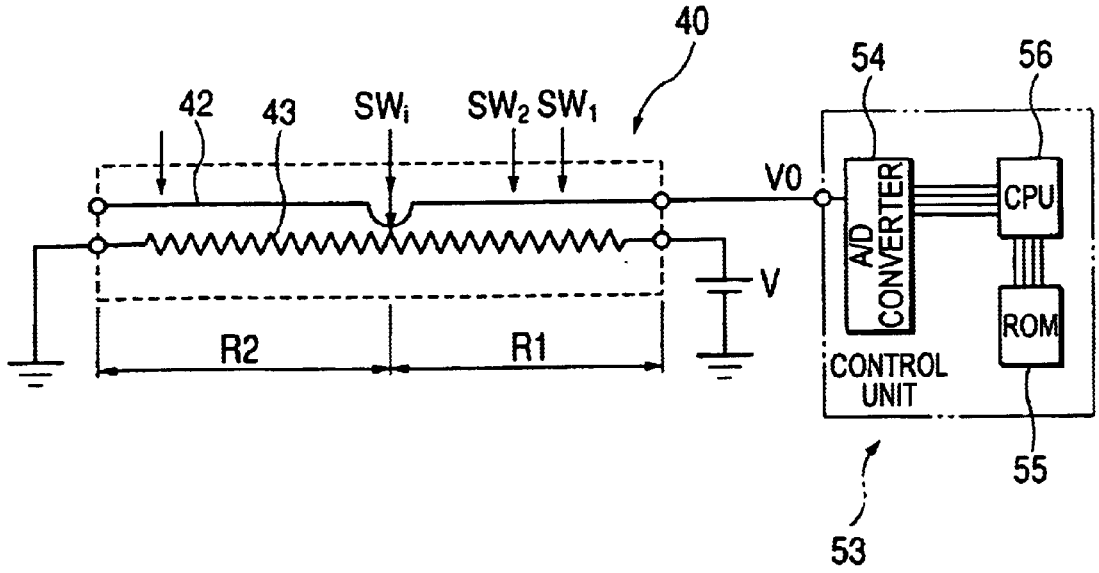
FIG. 10 is a view for explaining the circuit configuration of a control unit according to a second embodiment of this invention.

The circuit configuration of the control unit 53 for deciding whether or not the operation button is pressed should not be limited to that shown in FIG. 5. For example, as shown in FIG. 10, inner resistor member 43 may be arranged with its one end connected to ground and with the other end to which a prescribed voltage V is applied. In this case, with respect to the position where the outer resistor member 42 and the inner resistor member 43 have been brought into contact with each other by the operation of the operation button 36, assuming that the resistance of the inner resistor member 43 on the side where a voltage V is applied is R1, that on the side of grounding is R2 and the outer resistor member 42 is made of good conductor with the resistance of substantially zero, the analog voltage V0 which is generated in the A/D converter 54 can be represented by Equation $V0=R2\cdot V/(R1+R2)$. Thus, in the same manner as described above, which operation button is pressed can be decided.

Figure 11:
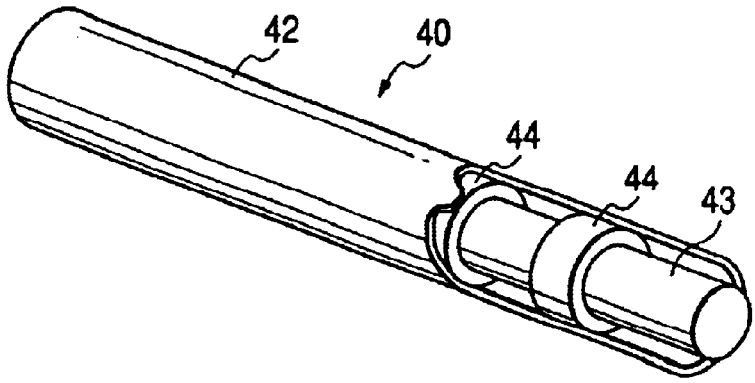
FIG. 11 is a view of a resistor body according to a third embodiment of this invention.
Figure 12:
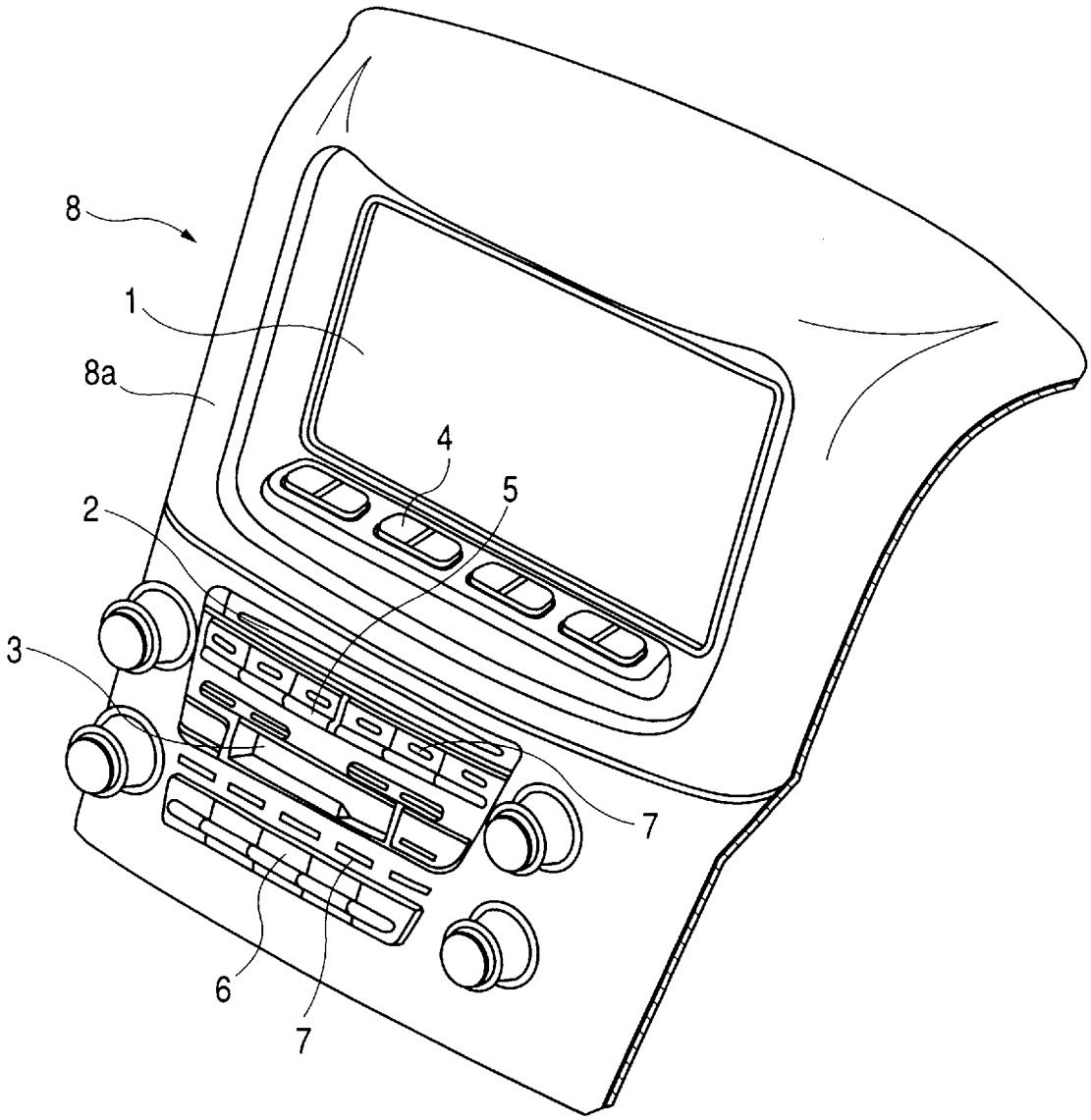
FIG. 12 is a perspective view of an operation panel according to a prior art.
Figure 13:
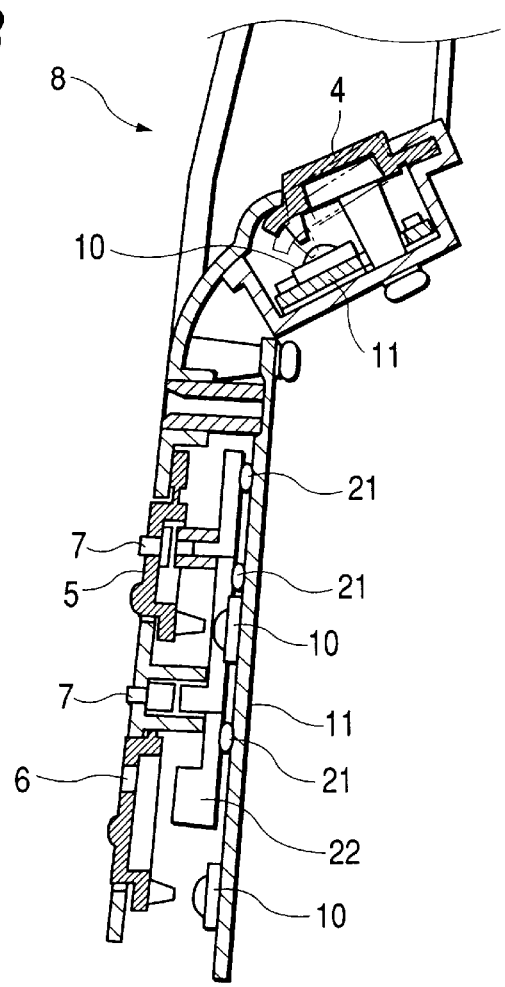
FIG. 13 is a sectional side view of the convention operation panel.
Figure 14:
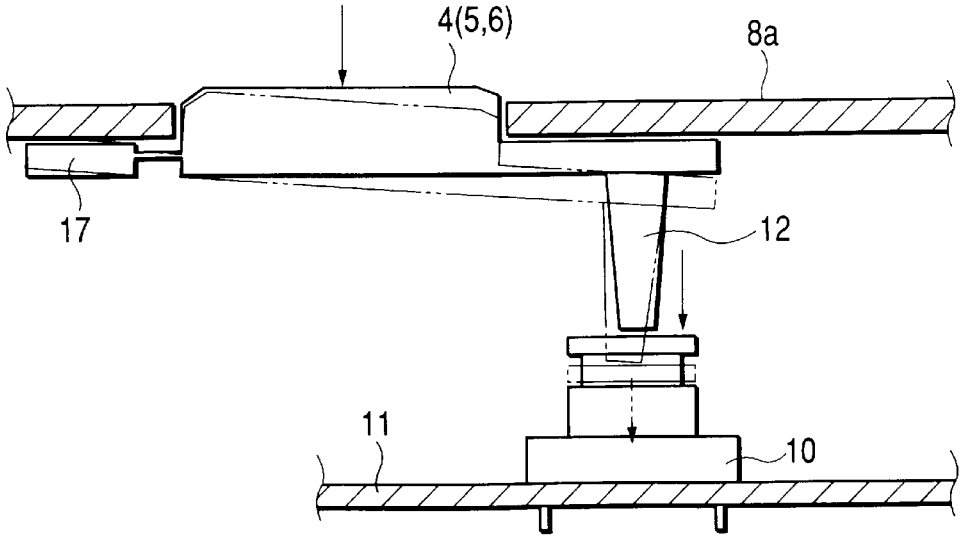
FIG. 14 is a view for explaining the operation of an operation button according to the prior art.
Figure 15:
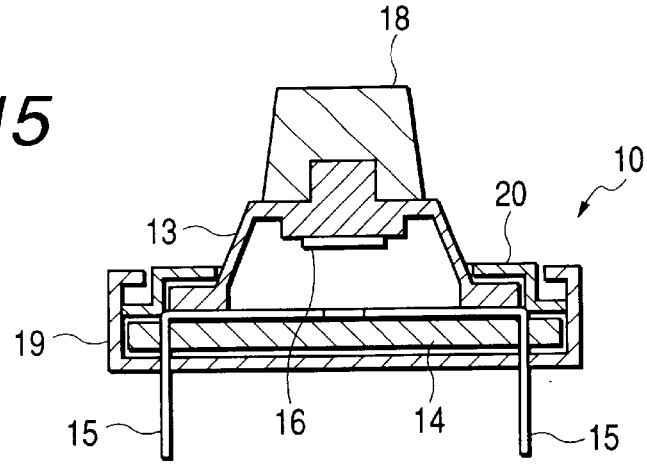
FIG. 15 is a view for explaining the operation of a rubber contact switch according to the prior art.
Figure 16:
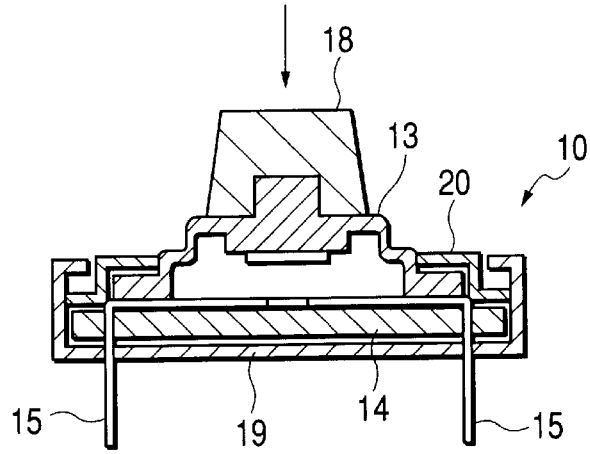
FIG. 16 is a view for explaining the operation of a rubber contact switch according to the prior art.
Figure 17:
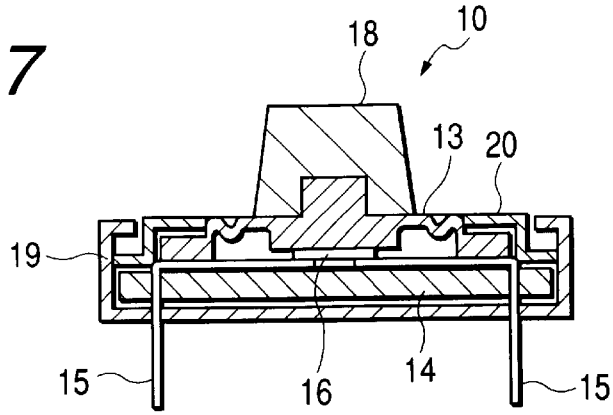
FIG. 17 is a view for explaining the operation of a rubber contact switch according to the prior art.

Further, although the inner resistor member 43 is formed as a composite structure including the insulating cord 43*a* and the enamel wire 43*b* wound around it, it should not be limited to such a structure. For example, as shown in FIG. 11, it may be a single resistor string having a certain diameter.

Although the rubber contacts 46 are coupled with one another by the coupling plate 47, they may be formed as individual members which are separate from one another. In this case, the respective rubber contacts 46 may be individually mounted at predetermined positions on the resistor holding plate 31.

Further, in this embodiment, the operation panel device is illustrated for use with a motor vehicle, it may be applied to any other machine or apparatus.

As described above, an operation panel device according to this invention has a structure in which a string-like resistor is held in a resistor holding plate, the resistor having a tube-like elastic outer resistor member, an inner resistor member loosely arranged within the outer resistor member and insulating spacers arranged between the inner resistor member and the outer resistor member at predetermined intervals in the longitudinal direction of the inner resistor member so that he inner periphery of the outer resistor member and outer periphery of the inner resistor member are constantly separated from each other, and a control unit is provided to produce an operation signal, whereby when each operation button is pressed, at the corresponding position, the outer resistor member is elastically deformed to be brought into contact with the inner resistor member so that the control unit decides which operation button is pressed on the basis of the resistance at an individual contact position and produces the corresponding operation signal. Because of such a structure, even when the operation panel has a complicate curved surface, the resistor body can be easily arranged along a varying-curved surface. Thus, the freedom in the design of the operation panel can be improved. Further, it is not necessary to use expensive printed boards, a connecting structure therebetween and rubber contact switches. This contribute to the cost reduction.

The operation panel device may have a structure in which the resistor holding plate has a groove in which the resistor body is to be firmly positioned. Because of such a structure, the resistor body has only to be arranged along the groove. Thus, the resistor body can be easily positioned and its deviation from the correct position can be effectively prevented. This improves the workability of arrangement of the resistor body.

The operation panel device has a structure in which a plurality of rubber contacts of an elastic material are arranged so as to correspond to the positions where the outer resistor member is pushed by pressing each the operation buttons, the rubber contacts each including a push-in operation member and a skirt member which is enlarged in the hem toward the outer resistor member. This structure assures good tactile feeling when each operation button is pressed.

The operation panel may have a structure in which a coupling plate is integrally provided to couple the plurality of rubber contacts with one another on the side of their hems. This structure improved the workability of mounting the resistor holding plate.

The operation panel may have a structure in which the rubber contacts are attached to the resistor holding plate so that the resistor body is held in the groove. This structure improves the workability of combining the resistor body with the resistor holding plate.

The operation panel device may have a structure in which a light source for illumination is provided within a case of the operation panel device and the resistor holding plate constituting the case is made smooth in the inner surface. Because of such a structure, the light from the light source for illumination can be guided to necessary positions by the reflection. This permits the simplified structure to be provided at low cost.

The operation panel device may have a structure in which optical fibers are provided for guiding light to respective indicators of the operation buttons. Because of this structure, the flexibility of the optical fibers permits the positions of arranging the indicators 38 to be easily changed. This improves the freedom of designing the operation panel.

What is claimed is:

1. An operation panel device comprising:

a plurality of operation buttons from each of which corresponding operation signal is produced according to the operation of each button;

a string resistor body held in a resistor holding plate;

said string resistor body including;

a tube elastic outer resistor member;

an inner resistor member loosely arranged within said outer resistor member; and insulating spacers arranged between said inner resistor member and said outer resistor member at predetermined intervals in the longitudinal direction of said inner resistor member so that the inner periphery of said outer resistor member and outer periphery of said inner resistor member are constantly separated from each other; and a control unit provided to produce said operation signal, when each operation button is pressed, at the corresponding position, said outer resistor member is elastically deformed to be brought into contact with said inner resistor member so that said control unit decides which operation button is pressed on the basis of the resistance at an individual contact position and produces the corresponding operation signal.

2. The operation panel device according to claim 1, wherein said resistor holding plate has a groove in which said resistor body is to be firmly positioned.

3. The operation panel device according to claim 1, wherein a plurality of rubber contacts of an elastic material are arranged so as to correspond to the positions where said outer resistor member is pushed by pressing each said operation buttons, said rubber contacts each including a push-in operation member and a skirt member which is enlarged in a hem toward said outer resistor member.

4. The operation panel device according to claim 3, further comprising:

a coupling plate integrally provided to couple the plurality of rubber contacts with one another on the side of the hems.

5. The operation panel device according to claim 3, further comprising:

said rubber contacts attached to said resistor holding plate so that said resistor body is held in the groove.

6. The operation panel device according to claim 1, further comprising:

a light source for illumination provided within a case of said operation panel device, wherein said resistor holding plate constituting said case is made smooth in the inner surface.

7. The operation panel device according to claim 1, further comprising:

optical fibers provided for guiding light to respective indicators of said operation buttons.

* * * * *